United States Patent [19]

Karn

[11] Patent Number: 4,563,235

[45] Date of Patent: Jan. 7, 1986

[54] HAND-HELD LABELER

[75] Inventor: Donald L. Karn, Springboro, Ohio

[73] Assignee: Monarch Marking Systems, Inc., Dayton, Ohio

[21] Appl. No.: 725,615

[22] Filed: Apr. 22, 1985

[51] Int. Cl.[4] ..... B65C 11/00

[52] U.S. Cl. ..... 156/577; 156/579; 156/584; 156/DIG. 48

[58] Field of Search ..... 156/384, 541, 577, 579, 156/584, DIG. 48, DIG. 49; 101/288

[56] References Cited

U.S. PATENT DOCUMENTS

| | | | |
|---|---|---|---|
| 3,440,123 | 4/1969 | Hamisch, Sr. | 156/384 |
| 4,116,747 | 9/1978 | Hamisch, Jr. | 156/384 |
| 4,148,678 | 4/1979 | Fogle et al. | 156/384 |
| 4,267,006 | 5/1981 | Karn et al. | 156/384 |

FOREIGN PATENT DOCUMENTS 1167002 5/1984 Canada .

*Primary Examiner*—Michael Wityshyn
*Attorney, Agent, or Firm*—Joseph J. Grass

[57] ABSTRACT

There is disclosed a hand-held labeler for applying labels from a composite label web wound into a label roll. The labeler has a cantilevered leaf spring which supports a portion of the composite that has been paid out of the label roll. A pair of fingers is cantilevered to the leaf spring and is in straddling operative relationship to the label roll. A cooperative arrangement on the labeler housing and on the fingers retains the fingers in the operative relationship while enabling the leaf spring to deflect.

6 Claims, 8 Drawing Figures

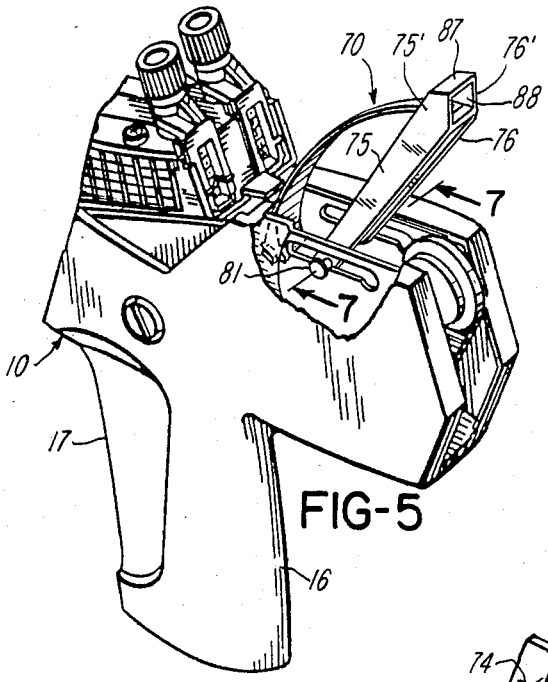
FIG-5
FIG-6
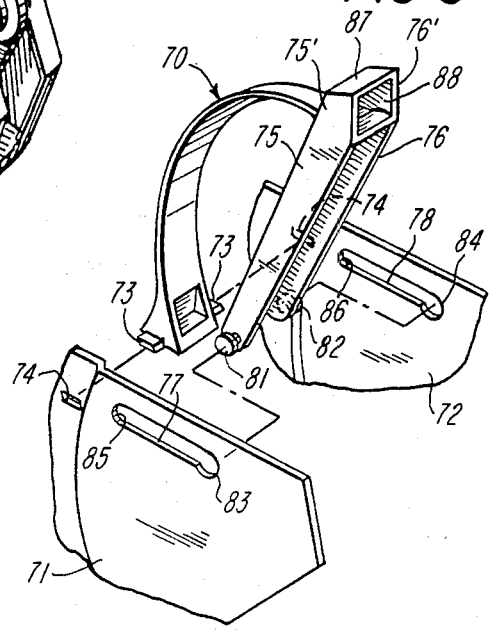
FIG-7
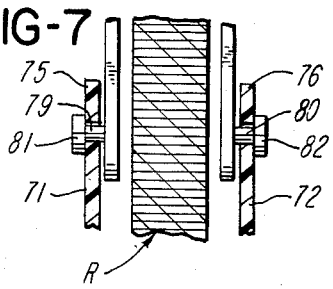
FIG-8
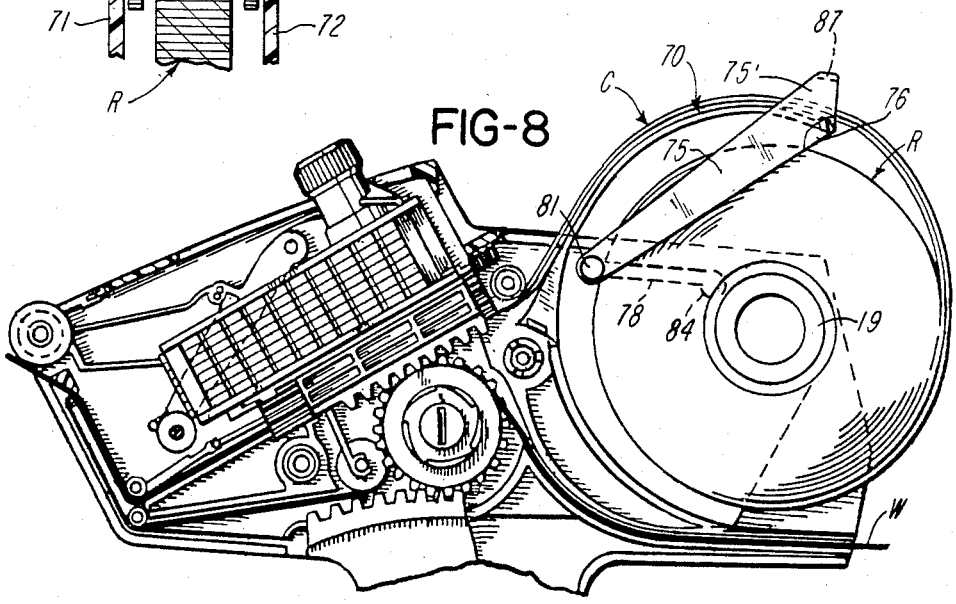

HAND-HELD LABELER

BACKGROUND OF THE INVENTION

1. Field of the Invention

This invention relates to the art of hand-held labelers.

2. Brief Description of the Prior Art

The following patents are made of record: U.S. Pat. Nos. 3,440,123, 4,116,747, 4,148,678 and Canadian Pat. No. 1,167,002.

SUMMARY OF THE INVENTION

The invention relates to an improved hand-held labeler. The labeler uses a composite label web wound into a label roll. The composite label web includes a carrier web and labels secured by pressure sensitive adhesive to the carrier web. The invention includes a leaf spring which supports a portion of the composite web which has been paid out of the label roll. The leaf spring can deflect as the composite web is advanced stepwise during operation of the labeler. The leaf spring projects beyond the housing and can also be in a deflected condition in a shipping container. The leaf spring can also deflect when the labeler is dropped. A pair of fingers is cantilevered to the leaf spring and the fingers are in straddling operative relationship with the sides of the label roll for obviating excessive telescoping of the label roll. The improvement relates to an arrangement for retaining the fingers in operative relationship while allowing the leaf spring to deflect. Thus, the leaf spring and the fingers can be displaced during the aforedescribed conditions of deflection without the fingers being moved out of operative relationship.

According to a specific embodiment of the invention, each finger is captured so that the fingers retain their operative relationship with respect to the label roll even though the leaf spring has been deflected. It is preferred to provide a pair of guides with which the fingers cooperate for guided movement as the leaf spring deflects. More specifically, the fingers preferably include projections cooperable with the guides for guiding the fingers in captured operative relationship as the leaf spring deflects.

BRIEF DESCRIPTION OF THE DRAWINGS

FIG. 5 is a fragmentary perspective view of a labeler in accordance with the invention;

FIG. 6 is a fragmentary exploded perspective view of a unitary leaf spring and fingers, together with finger-retaining structure;

FIG. 7 is a partly sectional view showing the fingers straddling the label roll and captive by the housing; and FIG. 8 is a elevational view showing the leaf spring in its maximum deflected position.

DETAILED DESCRIPTION OF THE PREFERRED EMBODIMENTS

Figures 1, 2, 3, 4:
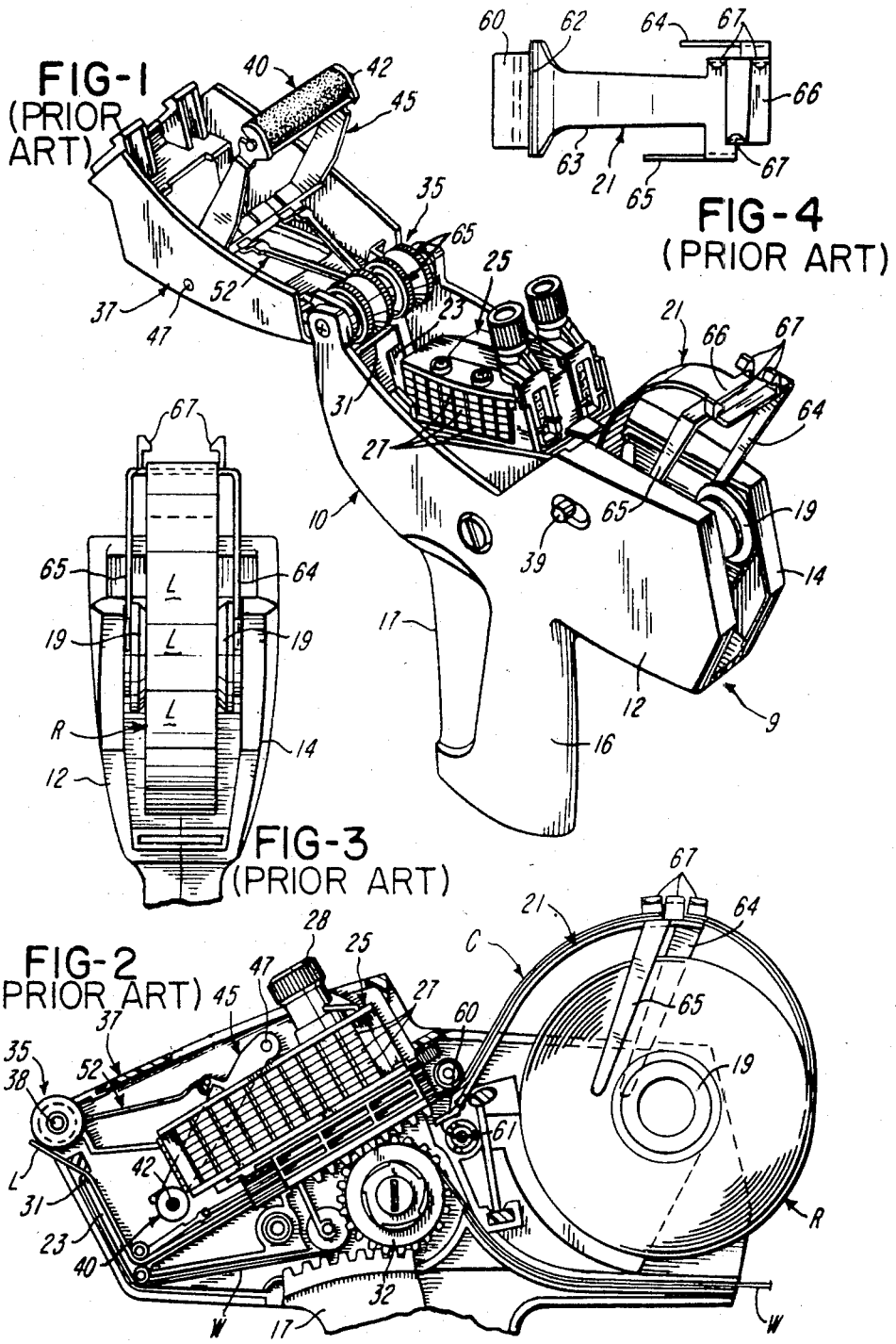
FIG-1 (PRIOR ART)
FIG-4 (PRIOR ART)
FIG-3 (PRIOR ART)
FIG-2 (PRIOR ART)
FIG. 1 is a perspective view of a hand-held labeler having a print head cover portion shown in its open position and illustrating a prior art labeler.
FIG. 2 is a fragmentary vertical sectional view through the labeler shown in FIG. 1, but showing a label-carrying web threaded through the apparatus, the web being arranged in a roll mounted by the labeler.
FIG. 3 is a rear elevational view of the labeler and label roll shown in FIG. 2.
FIG. 4 is a top plan view of a leaf spring and a pair of spring fingers for straddling the label roll also shown in FIGS. 1, 2 and 3.

The hand-held labeler 9 illustrated in FIG. 1 incorporates a housing 10 which includes two mating side sections 12 and 14 which are preferably molded of a plastics material. The housing 10 also includes a handle portion 16 having an actuator 17. The specific construction of the housing 10 and the components enclosed therein are described in above-mentioned U.S. Pat. No. 4,116,747 incorporated herein by reference. The labeler 9 is adapted to receive a supply of pressure sensitive labels L which are carried by a carrier web W and wound into a label roll R inserted between the opposing freely rotatable mounting members or hub members 19. The carrier web W and the labels L define a composite web C. A molded plastic leaf spring 21 guides the web W and labels L which it carries into the labeler 9, and the web W is directed upwardly across the inner surface of a flat platen 23 where the labels L are successively printed. Each pressure sensitive label L is printed on the platen 23 by movement of the print head 25 in response to retraction of the actuator 17, and the web W is advanced by a predetermined increment when the actuator 7 is released. The printed label L is peeled from the carrier web 10 at a delaminator 31 where the carrier web reverses and is directed downwardly and rearwardly through the labeler 9 and around a ratchet type indexing drive wheel 32 enclosed within the housing 10. As each printed label L is fed past the delaminator 31, the label L is positioned to be applied to an article by a label applicator 35.

In a manner as illustrated in above-mentioned U.S. Pat. No. 4,116,747, the print head 25 is enclosed or covered by a molded plastic cover section 37 which is pivotally connected to the mating housing sections 12 and 14 by a cross shaft 38. The closure or cover section 37 is retained within its closed position by a latch mechanism which is released by pulling rearwardly on a set of outwardly projecting latch actuator knobs or pins 39, as explained in above-mentioned U.S. Pat. No. 4,116,747.

A replaceable ink applying roller 40 includes a porous ink retaining body or tube which is mounted on a pair of opposing hub members having corresponding outwardly projecting end journals 42. The ink roller 40 is supported and carried by a frame or holder 45 which is preferably molded of a plastics material and has a set of trunnions 47 projecting outwardly into aligned holes within the cover section 37 to form a pivot axis for the holder 45. The ink applying roller 40 and holder 45 are biased or urged toward a position where the ink roller 40 engages the printing characters on printing bands 27 and rolls across the characters in response to forward movement of the printing head 25. The biasing force is produced by a pair of spring members or elements 52 which are also molded of a plastics material such as nylon.

The leaf spring 21 has a mounting portion 60 cantilevered in opposed pockets 61. The mounting portion 60 is joined to a relatively wide portion 62 which is joined to a narrower portion 63. The deflection of the wide portion 62 is less than the deflection of the narrower portion 63. A pair of fingers 64 and 65 is connected to a marginal end portion 66 of the spring 21. The marginal end portion 66 is opposite the mounting portion 60. The spring 21 and the fingers 64 are preferably of one-piece molded plastics construction for ease of manufacture and to provide the desired functions with a minimum of parts. The fingers 64 and 65 are shown to be generally parallel to each other and to be disposed in straddling relationship with respect to the label roll R as best shown in FIGS. 2 and 3. As best shown in FIG. 3, the fingers 64 and 65 are spaced more widely apart than the mounting members 19 which mount the label roll R. Also, the finger 64 overlaps the mounting members 19 whereas the mounting member 65 does not quite overlap. The fingers 64 and 65 prevent excessive telescoping of the label roll R. Excessive telescoping is especially problemsome when the diameter of the roll R is large. As the diameter of the label roll R decreases with repeated label cycles, there is less tendency of the roll R to telescope than when the label roll R is full. As shown in FIGS. 2 and 3, the spring 21 also keeps the label roll from mushrooming. Mushrooming occurs when the roll R unwinds excessively, thereby causing the outer passes of the roll R to become loose. As mushrooming occurs one of the passes of the roll R will contact the underside of the leaf spring 21 which will offer frictional resistance. As shown in the drawings, the fingers 64 and 65 are relatively thin and are flexible and resilient so that if the labeler 10 is dropped or otherwise abused, there is not the tendency of the spring fingers 64 and 65 or the flexible resilient spring 21 to break or become bent out of shape. The fingers 64 and 65 are shown cantilevered to the spring 21 at end portion 66. The fingers 64 and 65 are shown to be offset lengthwise of the spring 21 to facilitate molding and this is a feature of the invention.

Three hook-shaped projections 67 are formed integrally with the sides of the marginal end portion 66. The projections 67 are shown to be offset lengthwise. The projections 67 are acknowledged to be prior art. The projections 67 guide the outer pass of the web as shown in FIGS. 2 and 3.

With reference to FIGS. 5, 6 and 8, there is shown a leaf spring generally indicated at 70 anchored at one end portion to spaced members 71 and 72 on the housing 10 by projections 73 received in holes 74. Spaced retainers or fingers 75 and 76 are cantilevered to the leaf spring 70 at its other end portion. The fingers 75 and 76 are shown to extend generally downwardly to between the members 71 and 72 in spaced but straddling relationship to the label roll R as best seen in FIG. 7. The members 71 and 72 have respective elongated guides or slots 77 and 78. The lower free ends of the fingers 75 and 76 are shown to have outwardly extending projections or guided members 79 and 80 which project through the slots 77 and 78 and terminate at heads 81 and 82. The heads 81 and 82 are wider than respective slots 77 and 78, as shown. Thus, the fingers 75 and 76 are captive so that the fingers 75 and 76 are always held in their operative position but nevertheless the spring 70 can deflect, as when the actuator 17 is operated, or as when the labeler is dropped, etc. The slots 77 and 78 have enlarged openings 83 and 84 which are only slightly larger than the heads 81 and 82 to aid in assembly.

FIG. 8 shows the fingers 75 and 76 at their extreme position of travel with projections 79 and 80 bottoming at ends 85 and 86 of the slots 77 and 78. This condition may occur when the labeler 10 is dropped. As shown in the drawings, the mounting members 19 overlap the openings 83 and 84 slightly to afford resistance to the heads 81 and 82 returning through openings 83 and 84 after assembly as for example when the labeler 10 is dropped. The arms 75 and 76 extend upwardly above the leaf spring 70 as indicated at 75' and 76' and are connected by a bridge 87 to provide a rectangular opening 88 for guiding the composite web C.

The leaf spring 70, fingers 75 and 76 including extensions 75' and 76' and bridge 87, and projections 79 and 80 with heads 81 and 82 constitute a unitary or one-piece molded plastics part.

Other embodiments and modifications of this invention will suggest themselves to those skilled in the art, and all such of these as come within the spirit of this invention are included within its scope as best defined by the appended claims.

I claim:

1. A hand-held labeler for applying labels from a composite web wound into a label roll, the composite web including a series of labels releasably secured to a carrier web, the labeler comprising: a housing having a handle, means for mounting a label roll on the housing, means for delaminating labels from the carrier web, means for applying delaminated labels, means for advancing the carrier web, means defining a feed path from the label roll to the delaminating means where the labels are successively delaminated from the carrier web and to the advancing means, wherein the advancing means includes a manually engageable actuator disposed at the handle, a leaf spring cantilevered to the housing, a pair of spaced fingers cantilevered to the leaf spring and in straddling operative relationship with the sides of the label roll for obviating excessive telescoping of the label roll, the leaf spring being deflectable by the composite web as the carrier web is advanced by the advancing means, and cooperating means on the fingers and on the housing for retaining the fingers in the operative relationship while enabling the leaf spring to deflect.

2. A hand-held labeler as defined in claim 1, wherein the cooperating means includes a pair of guides on the housing and guided members on the fingers captive by the guides.

3. A hand-held labeler as defined in claim 2, wherein the guides comprise a pair of elongated slots, and the guided members include projections received in the slots.

4. A hand-held labeler as defined in claim 2, wherein the guides comprise a pair of elongated slots, and each guided member includes an outwardly extending projection on each finger extending through the respective slot and a head on each projection for retaining the each projection in its respective slot.

5. A hand-held labeler as defined in claim 4, wherein the leaf spring, the fingers and the retaining means are of one-piece molded plastics construction.

6. A hand-held labeler as defined in claim 4, wherein each finger is deflectable, and wherein each slot has an enlarged opening for receiving the respective head, wherein the opening is smaller than the respective head, and wherein the heads can be inserted through the opening by bending the fingers.

* * * * *